United States Patent [19]

Cudd

[11] Patent Number: 4,950,005

[45] Date of Patent: Aug. 21, 1990

[54] LOCK DEADBOLT PROTECTOR

[75] Inventor: Charles A. Cudd, Duluth, Ga.

[73] Assignee: Yale Security Inc., Monroe, N.C.

[21] Appl. No.: 412,644

[22] Filed: Sep. 25, 1989

Related U.S. Application Data

[63] Continuation of Ser. No. 254,257, Oct. 6, 1988, abandoned.

[51] Int. Cl.[5] ..... E05B 63/20

[52] U.S. Cl. ..... 292/150; 70/107; 292/169.14; 292/333

[58] Field of Search ..... 70/107, 486, 124, 151 R; 292/150, 333, 169.14, 169.13, 335

[56] References Cited

U.S. PATENT DOCUMENTS

| | | | |
|---|---|---|---|
| Re. 26,677 | 10/1969 | Russell et al. | 70/151 R |
| 238,113 | 2/1881 | Hand | 70/107 |
| 950,108 | 2/1910 | Lawrence | 70/486 X |
| 1,302,873 | 5/1919 | Stiff | 292/335 |
| 1,816,134 | 7/1931 | Wood | 292/333 |
| 1,919,763 | 7/1933 | Allen | 292/333 |
| 2,836,051 | 5/1958 | Walters | 70/151 R |
| 3,672,714 | 6/1972 | Schultz | 70/107 X |
| 3,769,822 | 11/1973 | Yulkowski | 70/107 |
| 4,389,061 | 6/1983 | Foshee | 292/169.14 |
| 4,890,870 | 1/1990 | Miron | 292/333 |

FOREIGN PATENT DOCUMENTS

| | | | |
|---|---|---|---|
| 0115430 | 8/1984 | European Pat. Off. | 292/169.14 |
| 127146 | 3/1933 | Fed. Rep. of Germany | 70/151 R |
| 63812 | 8/1941 | Norway | 70/107 |
| 376968 | 7/1932 | United Kingdom | 292/333 |

*Primary Examiner*—Lloyd A. Gall

*Attorney, Agent, or Firm*—Dallett Hoopes

[57] ABSTRACT

Mortise lock has a guardbolt which, when depressed, moves a lever inside the lock. The end of the lever moves a vertically sliding interlock slide from a first position in which its fits in a recess in the deadbolt and blocks the throwing of the deadbolt, to a second position. In the second position the slide clears the recess and permits the deadbolt to be extended. This protects against the extension of the deadbolt unless the door is closed.

4 Claims, 1 Drawing Sheet

LOCK DEADBOLT PROTECTOR

This is a continuation of application Ser. No. 07/254,257, filed 10/6/88, abandoned.

BACKGROUND OF THE INVENTION

1. Field of the Invention

This invention relates to a mortise lock. More specifically, this invention relates to a mortise lock having means preventing the throwing of the deadbolt until a guardbolt is first deppessed.

2. Description of the Related Art Including Information Disclosed Under §§1.97–1.99

The prior art is, of course, replete with examples of mortise locks generally comprising a rectangular housing adapted to fit into an opening in the end of the door at waist level, and generally containing a latch and a separate deadbolt and operating means for both of them. The operating means for the latch is generally in the form of a rotatable cam which is driven by a handle. For the deadbolt the operating means is usually a turnbolt on the inside of the door and a key cylinder from the outside of the door.

It has been common to use such mortise locks in the doors of guest rooms in hotels and the like with the latch bolt automatically locking when the door is closed so that the door may be opened from the hallway, only by a key operating the lock cylinder. Mortise locks to such guest rooms have also included a deadbolt operated by a turnbolt from inside the guest room.

A problem has been experienced in the past in that the guest room maid in a hotel in making up the room has abused the deadbolt. As is conventional, the linen supply for the guest rooms is brought to the hallway outside a room on a wheeled supply cart, and it is from such a cart that the maid services the room. In servicing the room the maid will strip the beds of their soiled sheets and carry them out through the door. Although the maid has a key for the room, in order to avoid having to use the key to gain readmittance to the guest room, the maid will before leaving the room simply throw the deadbolt by turning the turnbolt and then let the door swing closed on her way out. Because the deadbolt is extended, it will engage the door frame, keeping the door from closing and therefore unlatched. Later, loaded with fresh linens, the maid will merely push the door open to get back into the room.

The above-described way of operating, while saving the maid energy and time, has been hard on both the deadbolt and the door frame, because hotel doors, generally being heavy, have relatively heavy-duty closers which will drive the door toward closed position, causing a severe impact of the deadbolt on the frame.

In the past, when because of the damage caused the maid is confronted and criticized for throwing the deadbolt, she has often proclaimed her innocence, saying that it was accidental. As a result, attempts have been made in the past to make it more difficult to throw the deadbolt with the door open. An example of such an attempt is found in the U.S. Pat. Re. No. 26,677 (copy enclosed) from a patent which issued on Aug. 22, 1967 to F. J. Russel et al. In this mortise-type lock an auxiliary bolt is provided having an inward horizontal arm which carries on it a blocking element which, unless the auxiliary latch is depressed, blocks the downward movement of a special linkage pivoted to the crank arm of the deadbolt operator. The mechanism of the resissue patent has been improved upon by providing a simpler and more easily operatable structure.

SUMMARY OF THE INVENTION

Under the present invention the mortise lock is provided with a special guardbolt. Inside the mortise housing a lever is mounted, pivoted at one end. Intermediate its ends it is accessible to the inner end of the guardbolt while the other end is provided with a cam follower. The adjacent deadbolt is formed with a recess, and a deadbolt interlock slide is mounted for vertical reciprocation. The slide may take one of two positions: the first position with its upper end in the recess and blocking the extension of the deadbolt, and the second position clearing the recess. The slide has an inclined cam suface and is shiftable from the first to second position by depressing the guardbolt which moves the lever, the follower engaging the inclined cam surface.

As a result, with the door closed and the strike depressing the guardbolt, the slide clears the recess and the deadbolt is throwable in the conventional manner by the guest. With the door open and the guardbolt extended, the slide is in its first position with the slide blocking the operation of the deadbolt. Thus, if a maid intends to throw the deadbolt with the door open, she would have to first manually depress the guardbolt. As a consequence, it is much more difficult for her to plead that the objectionable setting of the deadbolt was "accidental."

BRIEF DESCRIPTION OF THE DRAWINGS

Other objects and features of the invention will be apparent from the following specification and drawings, all of which disclose a non-limiting embodiment of the invention. In the drawings.

DESCRIPTION OF THE PREFERRED EMBODIMENT

Figure 1:
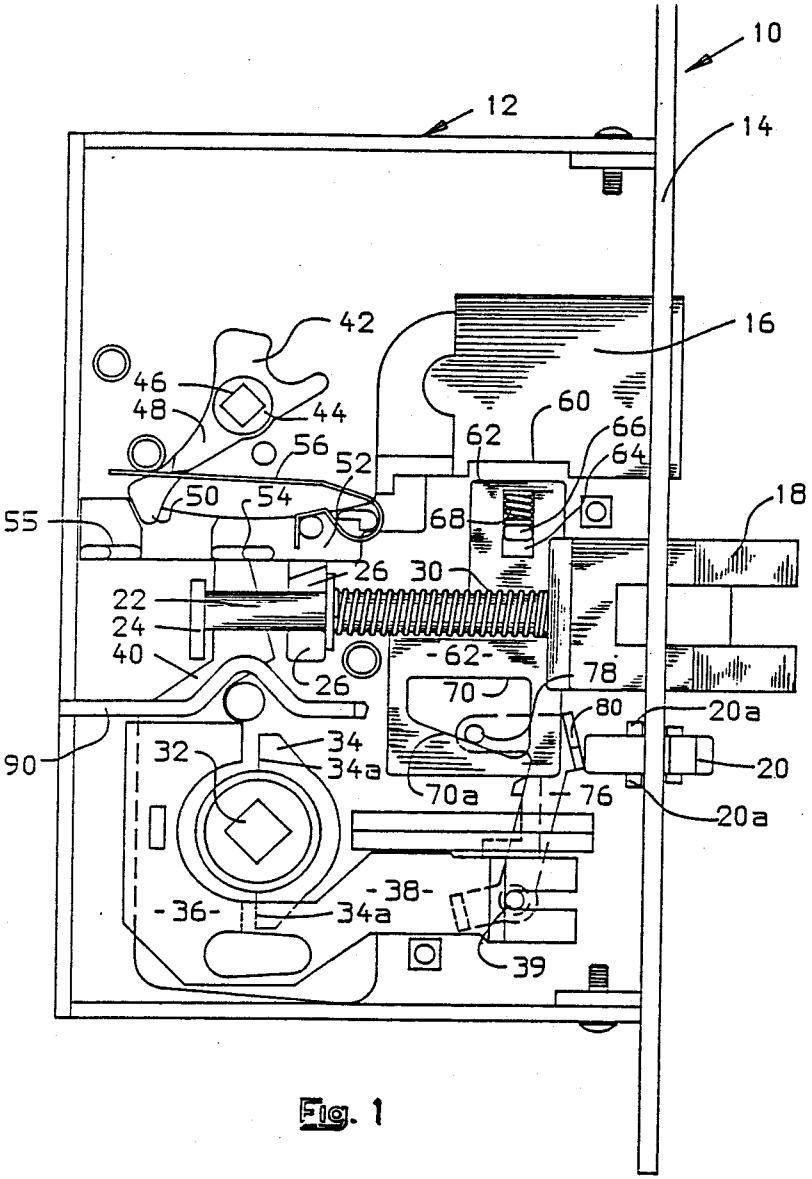
FIG. 1 is a simplified view of a mortise lock embodying the invention with the cover removed and showing the slide in the first position.

A mortise lock embodying the invention is generally designated 10 in FIG. 1. As shown with its cover removed, the lock includes a rectangular housing 12 having an apertured face plate 14 with its ends extending beyond the ends of the housing to be mounted against the end of the door as is conventional.

Extending through the aperture in the face plate 14 are the deadbolt 16, the latchbolt 18 and the guardbolt 20. Inside the housing the latchbolt 18 has a rearward reciprocable latch shaft 22 having a pull-back plate 24 on its inner end. A pair of projections 26 in the wall of the housing supports the latch shaft 22 in proper alignment. An axial spring 30 is disposed intermediate the projections 26 and the latchbolt 18 to bias the latch outward.

The spindle of the door handle (not shown) is square in shape and engages a square-shaped opening 32 in a pull-back 34 mounted for rotation between the side walls of the housing. The pull-back is formed with projections **34*a* which work against the latchbolt-operating assembly 36 rearwardly, slideably mounted in the housing. The assembly has a forward section 38 which is bifurcated at its end to straddle pin 39 mounted in the case. An arm 40 on the latchbolt assembly 36 engages the plate 24** when the pull-back is operated to retract the latchbolt, as is conventional.

The deadbolt operator 42 is mounted on a hub 44 journaled in aligned openings in the side walls of the housing 12. The hub is formed with a square opening 46 to receive the square spindle of a turnbolt (not shown). The operator 42 is provided with a leg 48 which carries on its distal end a toe 50. The deadbolt 16 has attached to its inner end a drive plate 52 having a pair of spaced lateral projections 54, 55. The drive plate 52 rests on the upper projection 26 and is stabilized by a hairpin-shaped spring 56. When the turnbolt (not shown) is turned, it rotates the operator 42 so that the toe 50, moving rightward (FIG. 1), engages projection 54, propelling the deadbolt 16 outward. In the retraction of the deadbolt the turnbolt is turned in the opposite direction and the toe 50 engages projection 55, retracting the deadbolt.

Above the deadbolt operating mechanism in the case 12 there is room for the conventional key-operated cylinder (not shown) having an operating lever which will engage the deadbolt operator so that the deadbolt may be operated from outside the door with a key.

Figure 2:
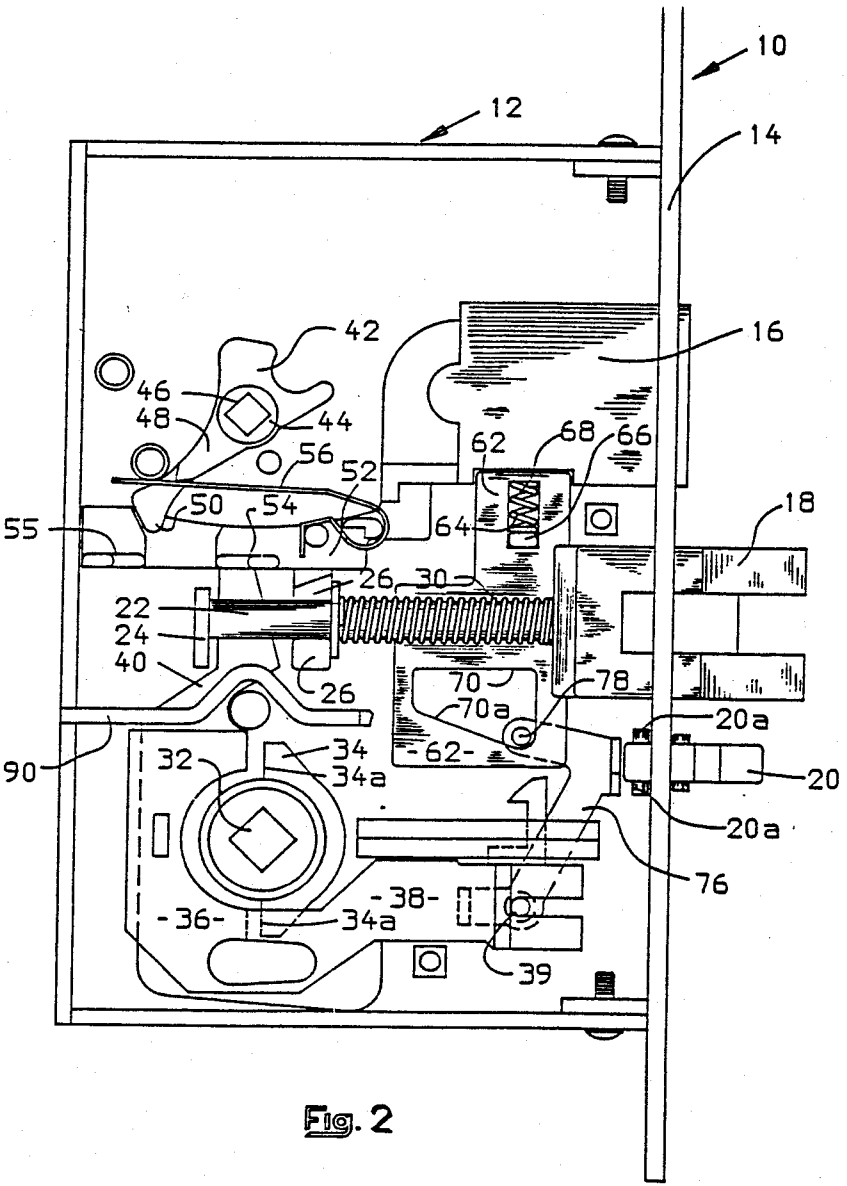
FIG. 2 is similar to FIG. 1 but shows the slide in the second position.

As shown in FIG. 1, the deadbolt 16 is formed with a recess 60 in its lower face. Vertically reciprocable below the deadbolt is the deadbolt interlock slide 62 which extends under the latch pullback shaft 22. Adjacent its upper end the slide 62 is narrowed and formed with a slot 64 which receives a projection 66 extending inward from the case side wall. A spiral spring 68 is disposed in compression between the projection 66 and the upper end of the slot 64, urging the slide upward toward a first position (FIG. 2) in which the upper end of the slide fits into the recess 60 in the deadbolt.

The lower end of the slide is broadened as shown and is formed with a window 70 the lower margin of which is inclined and serves as a cam surface for reasons to be described.

An L-shaped lever leg 76 is pivoted at its lower end to the pin 39. The distal end of the arm is provided with a transverse pin 78 which works against the surface **70*a* on the margin of the window. Intermediate the ends of the leg is the knee 80 which provides a flat surface engaged by the inward end of the guardbolt 20 when the latter is pivoted inward, either by manual depression or by engagement by the door strike when the door is closing. It will be noted that the guardbolt is provided with ears 20*a*** to provide a pivot.

By virtue of the structure presented when the guardbolt is depressed, its inner end engages and moves leftwardly the lever leg 76. This causes the pin 78 to move along the cam surface **70*a* and lower the slide 62 so that its upper end moves downward from the first position in the recess 60 to the second position shown in FIG. 1** in which the slide clears the recess and permits the deadbolt to be thrown.

When the door is subsequently opened, the guardbolt extends outward, driven by the spring 68 which raises the slide 62 so that the cam **70*a* moves the pin and lever leg to the right. The upper end of the slide resumes its first position blocking the throw of the deadbolt 16**.

It will be clear to those skilled in the art that the present invention greatly simplifies and makes more reliable than disclosures in the art the blocking of operation of a mortise lock deadbolt until the guardbolt is forced inward.

While the invention has been disclosed in only one form, it should be clear it is not so limited but is capable of many variations and modifications within the scope of the following claim language and equivalents thereof which define the invention.

What is claimed is:

1. A mortise lock for a door comprising:

a. a box-like housing having an apertured end plate adapted to be mounted in the end surface of a door, b. an outwardly biased latchbolt protruding through the end plate, c. an operator for said latchbolt, d. a deadbolt mounted in the housing for reciprocation through the end plate, e. a manual operator for projecting and retracting the deadbolt, f. deadbolt blocking means comprising:

(1) an outwardly biased guardbolt normally extending through the end plate, (2) the deadbolt being formed with a recess in its side more proximate the guardbolt, (3) a deadlock interlock slide mounted for vertical reciprocation in the housing and adapted to take a first position in which its upper end extends into the recess to prevent manual projection of the deadbolt and a second position farther away from the deadbolt to permit manual projection of the deadbolt, the slide being biased toward the first position, (4) cam means associated with the slide and guardbolt for driving the slide toward the second position as the guardbolt is moved in, whereby when the guardbolt is moved inward as by engagement with a door strike or by manual manipulation it moves the slide from first to second position and the deadbolt may then be manually projected.

2. A mortise lock for a door as claimed in claim 1 wherein the cam means comprises a surface on the slide inclined to the horizontal and pin means working against said surface and moved as the guardbolt is moved.

3. A mortise lock for a door as claimed in claim 2 wherein the pin is mounted on a lever arm which is pivoted in the housing and the guardbolt moves the pin.

4. A mortise lock for a door as claimed in claim 1 wherein an axial spring biases the slide toward the first position.

* * * * *